United States Patent [19]

Morrey et al.

[11] 4,292,896

[45] Oct. 6, 1981

[54] DETONATING DEVICE

[75] Inventors: William B. Morrey; David M. Welsh, both of Brownsburg, Canada

[73] Assignee: CXA Ltd./CXA Ltee, Montreal, Canada

[21] Appl. No.: 141,890

[22] Filed: Apr. 21, 1980

[30] Foreign Application Priority Data

May 31, 1979 [CA] Canada ..... 328796

[51] Int. Cl.[3] ..... F42B 3/10

[52] U.S. Cl. ..... 102/275.8

[58] Field of Search ..... 102/22 R, 24 R, 27 R

[56] References Cited

U.S. PATENT DOCUMENTS

| | | | |
|---|---|---|---|
| 2,911,910 | 11/1959 | Welsh, Jr. | 102/22 X |
| 3,046,887 | 7/1962 | Brinkley, Jr. et al. | 102/22 X |
| 3,113,518 | 12/1963 | Doan | 102/24 R |
| 3,543,370 | 12/1970 | Berman et al. | 102/24 R |
| 3,683,809 | 8/1972 | Burkle | 102/22 |
| 3,760,728 | 9/1973 | McKee et al. | 102/24 R |

*Primary Examiner*—Peter A. Nelson

[57] ABSTRACT

An improved cord-like detonating device is provided for use in non-electric blasting methods. The device comprises a substantially standard detonating cord length wherein a central longitudinal core of the cord consists of a hollow, low energy shock wave conductor. The device has particular utility in long hole blasting with toe priming. Initiating energy can be transmitted down the hole to the toe primer charge through the low energy shock wave conductor. The detonating primer initiates the outer detonating cord sheath which transmits energy to set off additional primer charges attached thereto.

1 Claim, 3 Drawing Figures

DETONATING DEVICE

Figure 1:
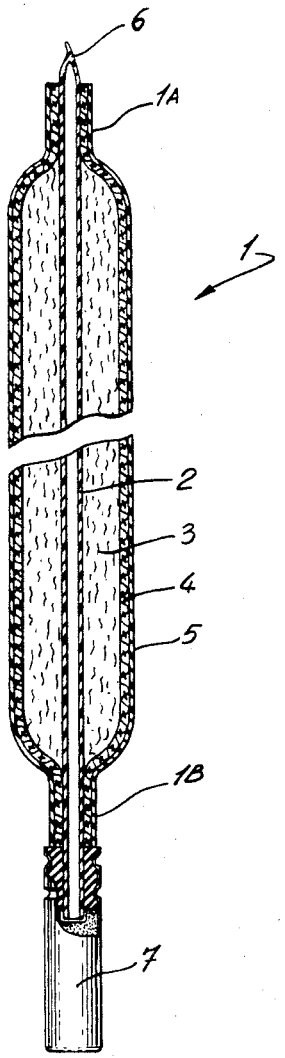

This invention relates to the art of blasting with explosives and, particularly, to a non-electric blasting method and to a novel detonating device used in such a method.

The use of non-electric instantaneous and delay period blasting caps initiated by means of low energy detonating cord as replacement for electric caps and conductive wire initiation, is now a widely adopted practice in blasting operations wherever hazards may be present due to stray electric currents. Such non-electric delay blasting systems are disclosed, for example, in British Pat. No. 858,794 and in Canadian Pat. No. 932,583. A suitable type of delay blasting cap for use in a non-electric system is disclosed, for example, in Canadian Pat. No. 627,435 which type of cap is normally initiated by means of low energy detonating cord (LEDC). More recently, a novel type of low energy detonating tube, suitable for use in non-electric blasting systems and sold under the name "Nonel" (®), has been disclosed in Canadian Pat. No. 878,056. Such a detonating tube, because of its construction and function, may more appropriately be called a low energy shock wave conductor.

To achieve the optimum effect in long hole blasting techniques, such as are used in open cast mining and quarrying wherein blasting agents are the explosive of choice, bottom hole or toe priming is the preferred method of initiation. (By blasting agents is meant explosive compositions which are insensitive to blasting cap initiation per se and comprise, for example, AN/FO, nitrocarbonitrate slurries and the like). In typical long hole blasting with toe priming, a sensitive primer or booster charge is placed in the bottom or toe of the borehole and is prepared for initiation by an attached initiating cord, low energy detonating cord (LEDC) or "Nonel" (®) shock wave tube and the borehole is thereafter filled with blasting agent. Because of the insensitivity of blasting agent compositions, it is often essential to place two or three or more of the additional primer charges at intervals throughout the length of the borehole as is shown, for example, in Canadian Pat. No. 932,583. This technique has created a number of problems for the blaster. Since optimum blasting is achieved by initiating the blasting agent charge from the bottom of the hole upwards towards the collar of the hole, it is first necessary to provide a non-electric downline to initiate the bottom or toe booster. The downline must be of very low energy in order that the explosive charge in the borehole is precluded from detonating or disruption from the downline. The second, third and other primers are then initiated in sequence from the bottom of the borehole by providing an upline of conventional high energy detonating cord, attached to the bottom primer and to which the additional primer charges are also attached. Upon initiation of the bottom primer by the low energy downline, the conventional detonating cord upline is set off and carries an initiating energy to the sequential primers aligned in the borehole above the bottom primer thus ensuring complete detonation of the blasting agent contained in the borehole. The difficulty in preparing such an initiation assembly comprising a separate downline and upline of different materials to which are attached in a planned sequence several booster charges, will be self-evident. One effort to solve this problem is disclosed, for example, in U.S. Pat. No. 4,024,817 where there is disclosed a detonating cord suitable for use as a downline in a charge-filled borehole, which cord comprises a detonating cord having an energy absorbing cover or layer on its outer surface which layer is alleged to prevent initiation or disruption of the explosive column through which is passes. The novel initiating device of the present invention, simply and practically overcomes this difficulty.

The present invention provides an elongated, flexible, unitary detonating device of determinate length for detonating one or more explosive primer charges within an explosive-charged borehole, the said device comprising in combination:

(a) a core member consisting of a low energy shock wave conductor comprising a hollow elongated tube having a reactive substance distributed as a thin layer on the inner surface thereof, and (b) a sheath member surrounding said core member over substantially its whole length except for a short non-surrounding section at each end of the length of the core member, said sheath member comprising a standard detonating cord construction capable of detonating a selected explosive booster charge.

The detonating device of the invention may be more simply described as a standard detonating cord having a hollow channel space within its core and extending over the entire length of the cord, the hollow channel comprising a low energy shock wave conductor.

Figure 3:
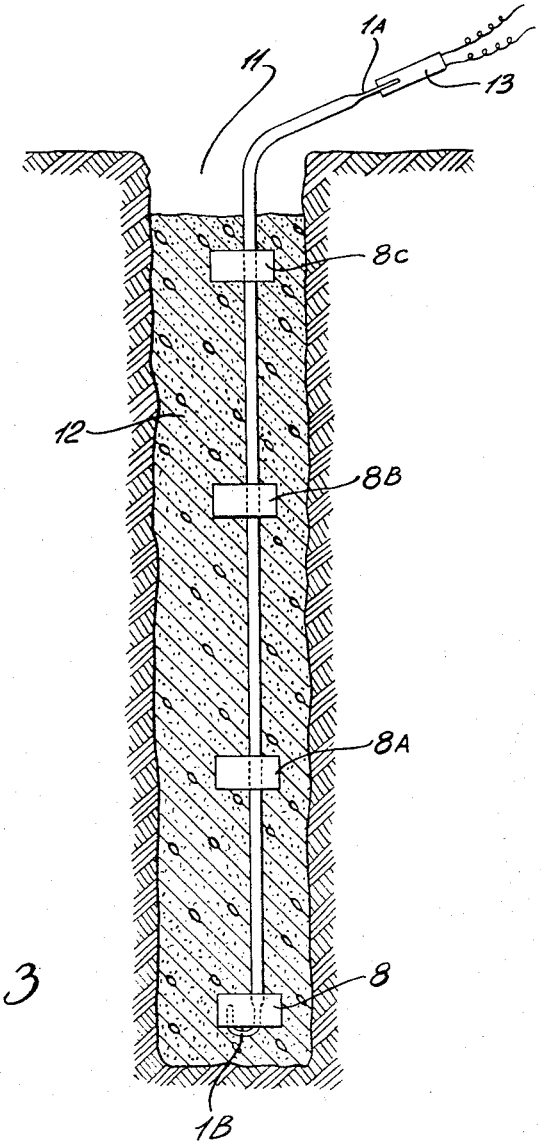
Figure 2:
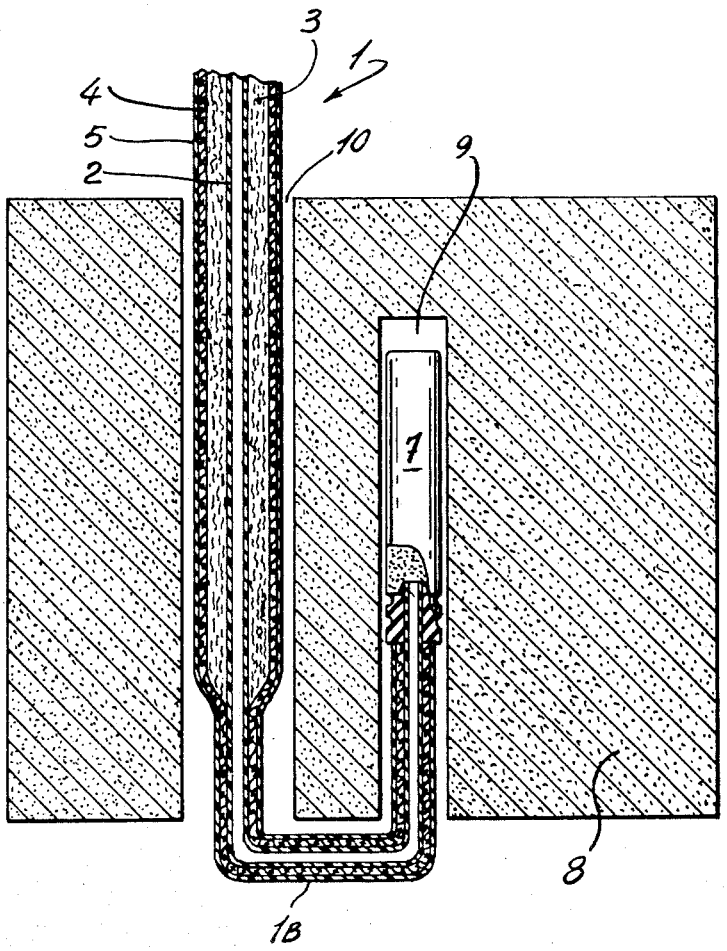

The detonating device of the invention is more fully illustrated with reference to the accompanying drawings wherein FIG. 1 is a cross-sectional partly perspective view of the detonating device of the invention;

FIG. 2 shows the device of FIG. 1 in association with a cast booster, and FIG. 3 is a cross-sectional view of a borehole showing a blasting system using the explosive device of the present invention.

Referring to FIG. 1, a determinate length of the elongated detonating device is generally designated as 1 and consists of a hollow tubular core member 2 comprising, for example, a length of "Nonel" (®) low energy shock wave conductor. Surrounding hollow core 2 is sheath 3 of sensitive high explosive material such as PETN or the like, commonly used in the manufacture of standard detonating cord. Surrounding high explosive sheath 3 is a wrapping 4 of, for example, textile fibre material. On the outside of wrapping 4 is a protective coating 5 of, for example, flexible plastic material. At one end of device 1, designated 1A, the high explosive sheath 3 is eliminated and a necked-down area devoid of any surrounding high explosive material is formed. The end 6 of core member 2 is sealed by, for example, heat sealing to protect the reactive material on the inner wall of core member 2. At the opposite end of device 1, designated 1B, a similar necked-down section is provided which is adapted for insertion into a detonator cap 7. The length of the necked-down sections 1A and 1B may be varied to accommodate attachment to various type of initiator caps or detonator devices.

Referring to FIG. 2, there is shown a cast or pressed explosive booster 8 of, for example, PETN or TNT containing a detonator cap well 9 and a channel 10. The end 1B of device 1 is shown threaded through channel 10 and the attached detonator 7 is inserted into cap well 9.

FIG. 3 show a vertical borehole 11 containing a column of explosives 12 such as ANFO or explosives slurry. A cast booster 8, such as is shown in FIG. 2, is positioned in the bottom of borehole 11. Elongated explosive device 1 extends from the surface through the explosive column 12 and is connected in detonating relationship with booster 8. Several additional boosters, 8A, 8B and 8C are axially spaced along and in initiating contact with device 1 in the borehole. An initiating device 13 is shown in initiating relationship with the necked-down end 1A of device 1. The necked-down end 1B of device 1 has attached thereto a detonator as shown in FIG. 2.

The elongated flexible detonating device of the invention is manufactured in the explosives factory in determinant lengths convenient for use in boreholes of various depths. The methods used in manufacture are similar to those generally employed in the manufacture of conventional detonating cord except that no high explosive material is located at each end (the necked-down section) of each length of the device. One suitable manufacturing method is disclosed, for example, in U.S. Pat. No. 3,621,558. The hollow core shock wave conductor component of the device is disclosed in U.S. Pat. No. 3,590,739.

In use in the field in, for example, a 50 foot deep borehole to be charged with, for example, an AN/FO blasting agent, the blaster will select a detonating device of the present invention having a similar 50 foot length and having attached at one (its lower) end an instantaneous or delay blasting cap of the type normally used with a "Nonel" (®) shoock wave conductor. The blaster will insert the blasting cap into the recess of a cast or pressed booster charge (PETN, TNT, or the like), the toe booster, and attach at chosen intervals along the length of the detonating device and in contact with the outer surface thereof, additional auxiliary cast or pressed boosters. The device will then be lowered into the borehole until the toe booster is close to or on the bottom of the borehole. Thereafter or simultaneously therewith the AN/FO blasting agent is charged into the borehole. Those skilled in the art will know that the auxiliary boosters may be of the slider type (see for example U.S. Pat. No. 4,141,296) and hence may be passed along or slidden down the device as the borehole is charged with AN/FO. The blaster will then attach to the exposed end of the device at the surface a suitable initiator of the type normally used with a "Nonel" (®) shock wave conductor. The charge is then ready for initiation. Upon initiation of the surface initiator, an energy wave is transmitted through the shock wave conductor to the toe booster to detonate it. No damage is caused to the outer detonation cord layer of the detonating device by the passage of the energy wave through the shock wave conductor. The initiation of the toe booster causes the detonation of the outer detonating cord layer of the device which detonation proceeds back along its length and up the borehole to initiate in sequence the auxiliary booster attached thereto, thus initiating the AN/FO charge from bottom to top of the borehole.

The novel detonating device of the invention thus provides a single, simple, convenient and economic means to provide bottom hole initiation of explosive charges in long hole blasting. The use of a dual downline/upline combination with its attendant assembly difficulties is eliminated, borehole charging is expedited and disruption of the explosive column prevented through use of the device. While use of the device has been particularly described herein with insensitive blasting agents, those skilled in the art will recognize that its use is not so limited and can be employed with any commercial explosive including nitroglycerine explosives and cap-sensitive slurries. With these more sensitive explosives charged into the borehole, the use of the auxiliary booster charges will not generally be necessary. However, use of the device in such case provides a detonating cord upline "tracing" of the borehole together with bottom initiation.

We claim:

1. An elongated, flexible, unitary detonating device of determinate length for detonating one or more explosive booster charges within an explosive-charged borehole, the said detonating device comprising in combination:

(a) a core member consisting of a low energy shock wave conductor comprising a hollow, elongated flexible tube having a reactive substance distributed as a thin layer on the inner surface thereof, and (b) a sheath member surrounding said core member over substantially its whole length except for a short non-surrounding section at each end of said core member, said sheath member comprising a standard detonating cord construction capable of detonating a selected booster charge in contact therewith, the said core member being incapable of laterally explosively initiating the said surrounding standard detonating cord sheath member.

* * * * *